United States Patent [19]

Payne

[11] 4,045,591

[45] Aug. 30, 1977

[54] METHOD OF TREATING SUCKER ROD

[75] Inventor: Bobby L. Payne, Midland, Tex.

[73] Assignee: Rodco, Inc., Odessa, Tex.

[ * ] Notice: The portion of the term of this patent subsequent to May 18, 1993, has been disclaimed.

[21] Appl. No.: 682,380

[22] Filed: May 3, 1976

Related U.S. Application Data

[63] Continuation-in-part of Ser. No. 490,210, July 19, 1974, Pat. No. 3,958,049, which is a continuation-in-part of Ser. No. 195,658, Nov. 4, 1971, abandoned.

[51] Int. Cl.[2] ..... E21B 17/00; C23C 7/00

[52] U.S. Cl. ..... 427/37; 427/292; 427/319; 427/327; 427/328; 427/405; 427/422; 427/425; 427/427; 166/244 C

[58] Field of Search ..... 166/176, 244 C; 427/405, 327, 328; 73/104, 105; 427/292, 319, 328, 422, 427, 425, 37

[56] References Cited

U.S. PATENT DOCUMENTS

| | | | |
|---|---|---|---|
| 2,126,430 | 8/1938 | Unger | 166/244 C |
| 2,217,719 | 10/1940 | Williams | 427/405 |
| 2,939,963 | 6/1960 | Rideout | 73/104 |
| 2,982,360 | 5/1961 | Morton et al. | 166/244 C |
| 3,009,100 | 11/1961 | Muchnick | 73/104 |
| 3,715,790 | 2/1973 | Reinberger | 427/328 |
| 3,942,230 | 3/1976 | Nolband | 427/405 |
| 3,958,049 | 5/1976 | Payne | 166/244 C |

*Primary Examiner*—Ralph S. Kendall
*Attorney, Agent, or Firm*—Marcus L. Bates

[57] ABSTRACT

A method of treating sucker rod comprising shot peening the rod to clean and harden the exterior surface thereof, preheating the rod, and coating the rod with a metal alloy by using an electric arc spray gun to provide a layer of alloy on the exterior surface thereof. The rod is subsequently cooled and then coated with a baked-on, plastic-like surface.

In one embodiment of the invention, used rod is first degreased, and following the shot peening operation the rod is subjected to an electronic test to determine the symmetry of compositon of the metal, as well as to ascertain if any flaws are present therein. The rod is then coated with metal and subsequently sprayed with plastic as in the above recited example.

10 Claims, 4 Drawing Figures

METHOD OF TREATING SUCKER ROD

REFERENCE TO RELATED APPLICATIONS

This application is a continuation in part of my copending application Ser. No. 490,210, filed July 19, 1974, entitled "Method of Inspecting and Treating Sucker Rod", now U.S. Pat. No. 3,958,049, which is a continuation in part of application Ser. No. 195,658, filed Nov. 4, 1971, now abandoned.

BACKGROUND OF THE INVENTION

Reference is made to my above-identified copending patent application for further background of this invention. As previously pointed out in Ser. No. 490,210, it is advantageous to coat the outer peripheral surface of a string of sucker rod with a suitable coating which acts as a barrier to the deleterious environment found downhole in a borehole. Various different geographical locations present various different problems respective to chemical attack upon the metal composition of the sucker rod. In pumping wellbores, the sucker rod is usually placed in intimate contact with $H_2S$, $H_2O$, free hydrogen ions, and various other harmful chemicals.

These chemicals may either catalyze the oxidation process of the metal sucker rod, or they may directly enter into various chemical reactions with the metal composition of the rod. It is therefore desirable to be able to protect the sucker rod by applying a coating which provides a barrier between the main metal body of the rod and the deleterious effects of the downhole fluids.

It is desirable to provide a wellbore with sucker rod which is absolutely reliable in structural integrity and which furthermore can withstand the onslaught of the various chemicals found downhole in a borehole.

A string of sucker rods having these desirable attributes will last indefinitely and therefore avoid replacement over a long period of time. Reliability of this magnitude has not heretofore been attained would represent a substantial savings in the cost of producing hydrocarbons. The present invention therefore has the unexpected advantage of longer life and therefore significantly reduces the cost of producing well bores.

SUMMARY OF THE INVENTION

The instant invention relates to a method of treating sucker rod and specifically to a process for improving the durable life of a string of new or used metal sucker rods by protecting the rods from detrimental chemical reactions usually associated with conditions found in a borehole. The process is carried out by cleaning the external surface of the rod to remove foreign matter therefrom and then mechanically cold-working the rod by shot peening the exterior surface thereof, thereby substantially improving the outer metallic structure of the rod.

In one embodiment of the invention, the sucker rod is electronically inspected following the shot peening operation in order to determine the symmetry of composition of the metal. The rod is next electronically inspected to determine the presence of structural defects or flaws therein. Structurally defective and unsuitable rods are discarded so that only sound rods are considered for further treatment.

In both embodiments of the invention, the rods are next preheated and then coated by an electric arc spray process which deposits a metal alloy on the outer peripheral surface thereof. The rod is cooled and then subjected to a second coating process wherein a plastic-like film is sprayed over the entire peripheral surface of the rod to thereby further seal the rod surface against future chemical attack.

Resistance to corrosion fatigue is unexpectedly enhanced by the elimination of microscopic surface defects brought about as a result of the shot peening and the subsequent metal coating operation. Hence, a structurally sound rod which has been processed in accordance with the present invention will exhibit an unexpected prolonged life when used downhole in a borehole.

A primary object of this invention is the provision of a method by which the life expectancy of new or used tubular goods can be significantly increased.

Another object of the present invention is to provide a method of reclaiming used sucker rod so as to provide a rod having an unusually long life expectancy.

A further object of this invention is to disclose and provide a method of rejuvenating and treating sucker rod so as to enable the rod to survive an acceptable length of time when the rod is used downhole in an oil well.

A still further object of this invention is to provide a method of treating tubular goods which reduces the probability of failure of the tubular goods when they are used downhole in an oil well.

Still another object of the present invention is to provide a process wherein the microscopic surface imperfections of a rod are eliminated by the combined steps of shot peening, metal coating, and polymer coating.

A further object of this invention is the provision of a rod having a plurality of new coatings formed thereon to provide a barrier against chemical attack when the rod is used downhole in a well bore.

These and various other objects and advantages of the invention will become readily apparent to those skilled in the art upon reading the following detailed description and claims and by referring to the accompanying drawings.

The above objects are attained in accordance with the present invention by the provision of a method of treating new and used sucker rod in a manner substantially as described in the above abstract and summary.

DETAILED DESCRIPTION OF THE PREFERRED EMBODIMENTS

Figure 1:
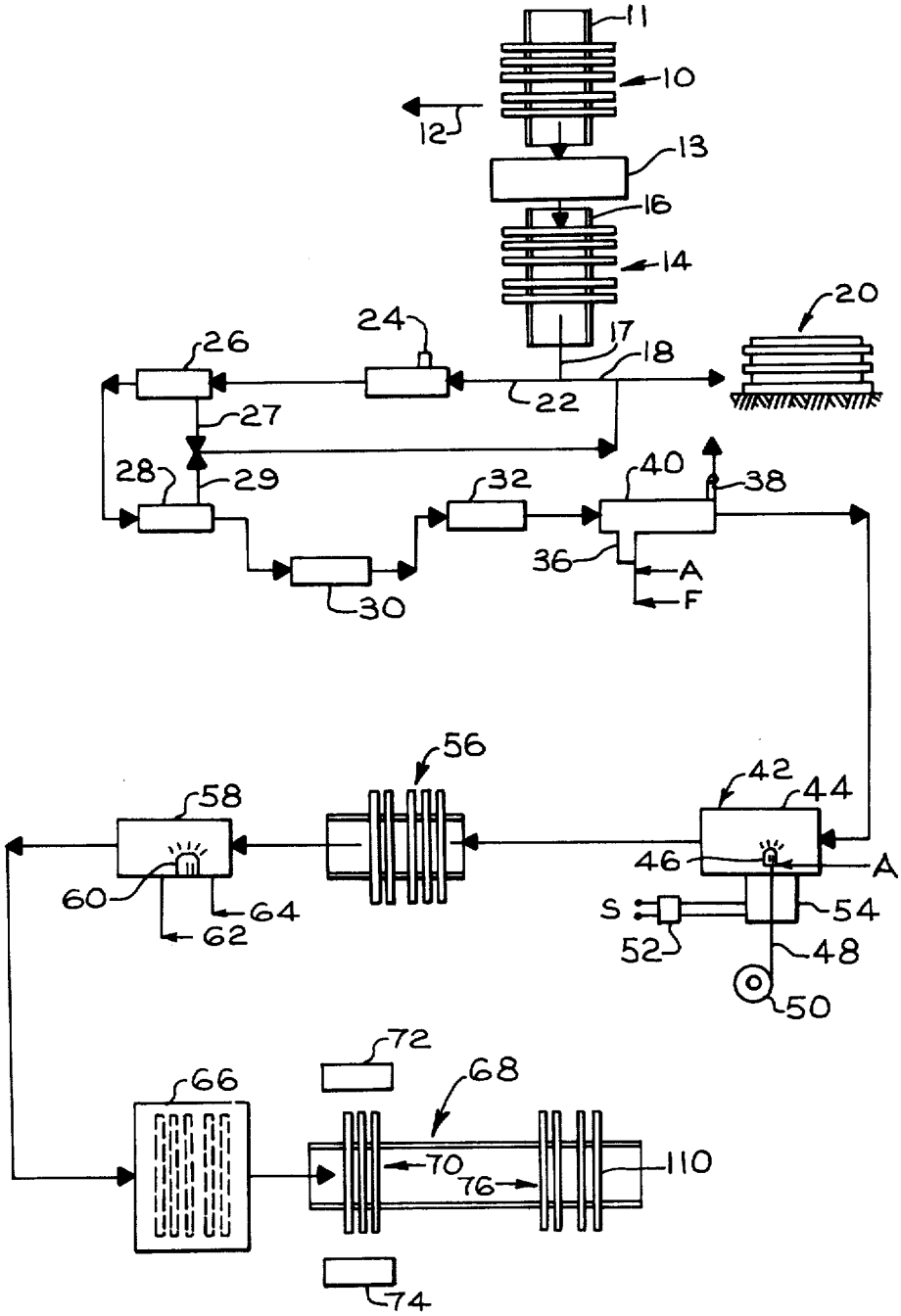
FIG. 1 diagrammatically presents a flow sheet which sets forth embodiment of the present invention.

FIG. 1 discloses used sucker rod 10 supported from a pipe rack 11. The used rod has been removed from downhole in a borehole. In carrying out the present invention, couplings which may be attached to the sucker rod are removed from the ends thereof as illustrated by the numeral 12. The rods are degreased by submerging them in a hot oil bath 13, after which the degreased rods 14 are placed upon a pipe rack 16 so they can drain and be subjected to careful visual inspection.

Any visually defective rod is removed at 18 and discarded at 20 while the apparently good rod at 22 is subjected to a mechanical cold working process which further cleans the exterior surface of the degreased rod.

The mechancial cold working step of the process preferably is carried out by shot peening at 24 after which the rod is electronically inspected at 26 by means of the differential eddy current method, the details of which are more fully discussed in my previously-mentioned patent application. Numeral 27 indicates defective rods which are removed from the continuous process. The inspected acceptable rod from 26 is next subjected to a magnetic induction inspection at 28 by means of the flux leakage method, the details of which are more fully disclosed in my above-mentioned patent application. Numeral 29 indicates that defective rods are removed from the continuous process, and returned to the rack at 20. The pin ends of the remaining rods are magnafluxed at 30 by the Magna-glo (TM) process. The couplings from 12 are also magnafluxed using the powdered metal process, and any defective couplings are removed from the process and discarded. The remaining sound rods and couplings are demagnetized at 32 so that the rod will not be attracted to metallic particles or to the production tubing of the borehole.

The rods are next preheated at 40 by a suitable oven having a burner 36 and a stack 38. A combustible mixture of air and fuel flow into the burner in order to provide a heat source, although other means could by employed for elevating the temperature of the rod.

The preheated rods enter the electric arc metal spray apparatus 42 which includes a housing 44 having a suitable metal spray head 46 enclosed therewithin. Numeral 48 illustrates one of the continuous welding rods which unwinds from reel 50 and is received by the head 46. Numeral 52 indicates an electrical control box connected to the illustrated source of current, thereby providing the electric arc machine 54 with a suitable supply of current so that the metal rod 48 is vaporized by the electrical arc provided at the welding head. The illustrated source of air is connected to the head and blows the vaporized metal particles onto the rod surface as the rod moves along its longitudinal axis enclosure 42. The details of the step at 42 are more fully illustrated in FIG. 3.

The rod is next racked at 56 to enable it to cool a considerable amount before it is received at the painting station 58. The rod preferably is maintained above room temperature and below 150° F. before it enters the painting station 58. The painting station includes a conventional paint nozzle 60 having a source of paint 62 and an air supply 64 connected thereto so that the entire outer peripheral surface of the rod receives a suitable coating of paint. The term "paint" is intended to include a polymer such as hereinafter more fully defined.

The rod next travels into an oven 66 where the painted surface is baked for an optimum length of time, whereupon the completed rod is subsequently moved onto the rack 68.

Spaced-apart stations 72 and 74 are placed in proximity of the opposed rod ends so that each pin end of the rod can be manually cleaned, with special emphasis being placed on proper preparation of rod end shoulders. The treated or rejuvenated rod is stored at 76.

Figure 2:
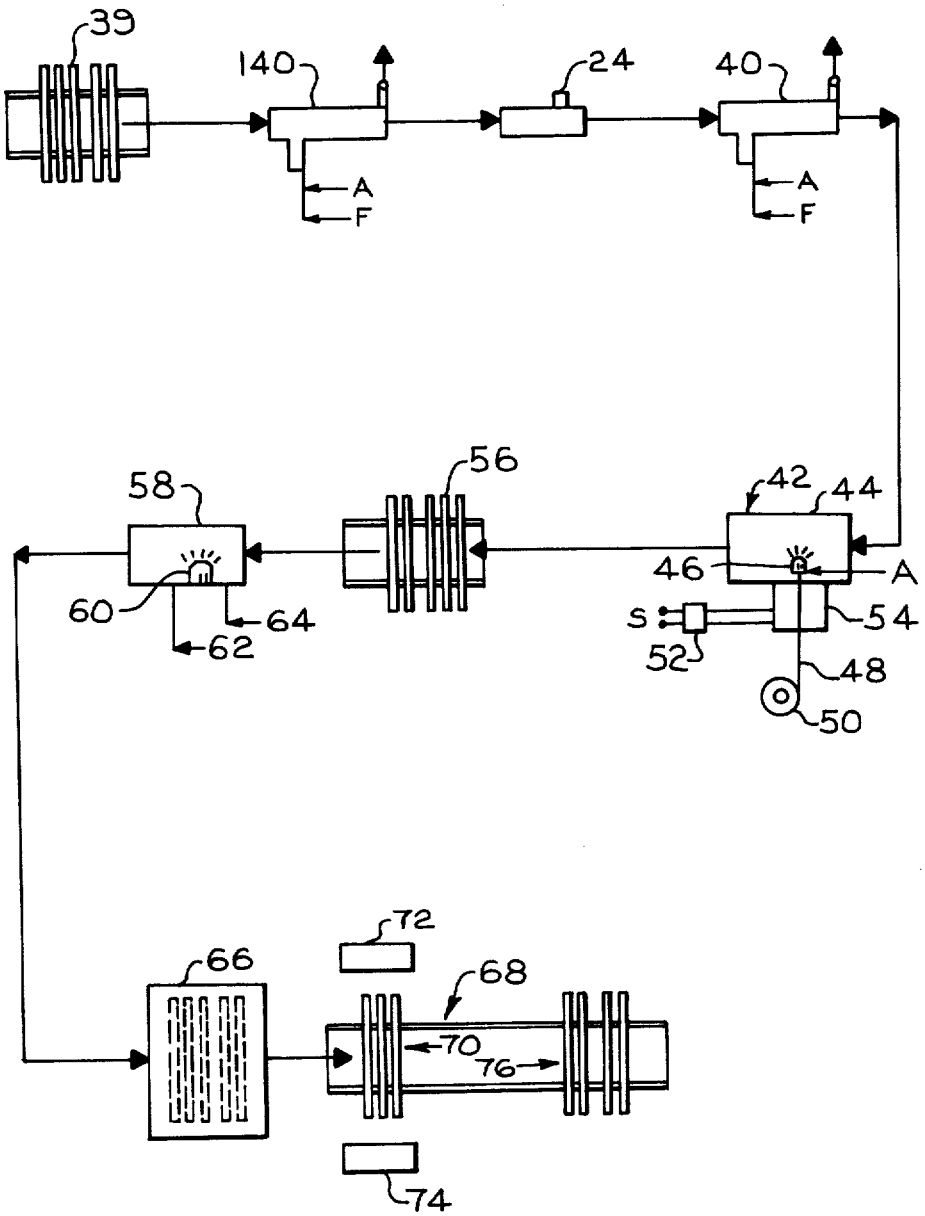
FIG. 2 is a part diagrammatical, part schematical representation of another process according to the present invention.

In the simplified embodiment of FIG. 2, the rods are stored upon a rack 39 until they are sequentially fed in a continuous manner through a preheater 140. The preheater elevates the rod temperature to approximately 150° F. The rod is next subjected to the shot peening operation 24; and thereafter, the temperature of the rod is further increased to approximately 200° F. by a secondary heater 40. Both the primary and secondary heaters are provided with a suitable source of combustible material such as exemplified by the illustrated air and fuel inlet. The remainder of the process is identical to FIG. 1; and therefore, it would appear repetitious to again specifically outline the details thereof.

EXAMPLE 1

New sucker rod is stored at 39 until a sufficient supply of rods have been accumulated to justify making a process run. The rods preferably are transported along the flow sheet of FIG. 2 in a continuous manner, with the opposed ends of the rod essentially abuttingly engaging one another. The rods are 25 feet in length and are conveyed from station 140 to station 56 at the rate of 22 to 25 rods per hour. Hence, each 25 foot rod requires about 2½ minutes for processing. The conveyor also rotates the rod about its longitudinal axis at about 150 rpm.

The rods are initially preheated at station 140 to a temperature of 150° F. This initial heating is preferably by direct flame impingement so that any contamination of a combustible nature is combusted into carbonaceous material by the preheater. The preheated rod next was shot peened at 24 by a commercially available Wheelabrator (TM) shot peening device. The shot peening operation removes all visible scale from the rotating rod surface and futhermore surface hardens the exterior of the rod and additionally elminates many of the small pits and surface cracks which may otherwise be present therein.

The rod next travels though the secondary heater where the temperature thereof is raised to approximately 210° F. The rotating rod is next conveyed into the electric arc metal spraying or coating chamber at approximately 210° F. The elevated temperature of the rod greatly enhances the bond formed between the vaporized metal issuing from the head of the arc gun. The rotating rod is imparted with a metal coating which is approximately .008 inches thickness.

Prior to receiving a coating of phenolic resin at 58, the rod is racked so that the temperature thereof is reduced to a value which is compatible with the selected paint. The painted rod next is transported into the oven where the phenolic resin is baked into a self-supporting, hard, protective film. The rod leaves the oven and receives the end treatment previously explained in conjunction with stations 72 and 74.

EXAMPLE 2

Used rods salvaged from a string which was removed from a borehole are broken out and racked at 11. The used rods are caused to continue to travel along the flow sheet of FIG. 1 in the before-described manner until the partially processed rods are racked after leaving the demagnetization station 32. Sometimes the rods next are coated with a corrosion-preventing compound so that no appreciable oxidation will occur prior to the rods being transported to the rack 39, where they subsequently receive the above-described treatment set forth in Example 1.

EXAMPLE 3

Clean rods are racked at 39. The rods may be new from the manufacturer, or the rods may have previously received the treatment provided by the process 11–32 of FIG. 1. In any event, the rods are processed through preheater 140 and Wheelabrator (TM) 24 in order to prepare the surface thereof for the coating received from the electric arc spray gun.

The rods continue on through the process equipment illustrated in FIG. 2 where the final product emerges at 76.

The rods preferably travel through the Wheelabrator (TM) at 24, electronic inspection station 26, and magnetic induction station 28 at a speed of 30 feet per minute while rotating 53 rpm to assure reliable visual inspection and efficient shot peening.

The shot peening apparatus subjects the exterior surface of the rod to a shower or bombardment of metallic shot, causing a plastic flow of the surface fibers of the metal. This action places the surface fibers of the metal in residual compression while the inner fibers are in tension so that working stresses that ordinarily impose a tension stress on the rod surface are offset by the residual stress brought about by the cold working action of the shot. The net result is a considerably greater endurance limit of the peened material. Shot peening increases resistance to fatigue fractures and accordingly increases the fatigue life of the metal. Shot peening further reduces corrosion and fatigue of the rod because the surface has greater continuity and accordingly there are not cracks or pits available for intrusion of hydrogen ions. Moreover, the shot peening operation presents a surface having characteristics which accept the alloy coating much better than would otherwise be realized. The details of the electric arc spray gun 46 are schematically disclosed in FIG. 3 and the gun is preferably a Metco type RG arc gun. It is preferred to use a stainless steel alloy rod 48 and 148 with 52 psig gas pressure at 82. The gas can be air, or an inert such as flue gases or nitrogen. The stainless steel coating maintained at about 0.008 inches thickness. The gun operates at 500 amps and 45 volts.

The metal wire is melted or softened by the gun 46 while the mass flow rate of the gas causes the vaporized metal to flow toward the outer surface of the sucker rod, thereby coating the rod with the alloy compostion of the wire. As the minute fluid particles of the vaporized wire impact against the surface of the rod, they spread about projections and pits on the imperfect surface of the rod to form a continuous or coherent structure.

It is contemplated to employ the gas flame method as well as the plasma-arc principle for coating the sucker rod. The electric arc spray gun is preferred, however, because the cost of operation is substantially less than the gas flame method and the temperatures which can be attained are also greater.

The phenolic resin used at the painting station is available from Metco Inc., Westbury, Long Island, N.Y. and is identified as Metco Seal PB Phenolic Resin.

Figure 3:
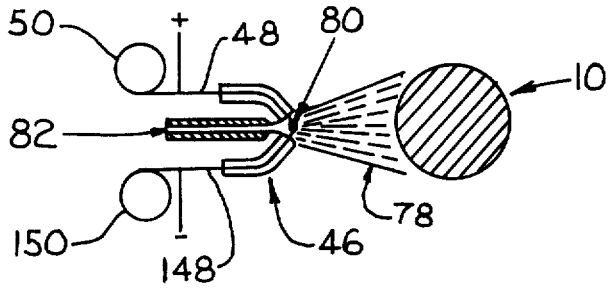
FIG. 3 is a part cross-sectional, detailed representation of part of the previous process disclosed in FIGS. 1 and 2; and, FIG. 4 is a cross-sectional view of the completed product made in accordance with the present invention.

During the coating process the rod is spaced about 6 inches from the nozzle 46, as schematically suggested in FIG. 3. The stainless steel rod 48 and 148 is wound on the reels 50 and 150; and as the continuous arc 80 vaporizes the metal, gas pressure at 82 forms a spray 78 which coats the rod surface as the rod rotates about its longitudinal axis and moves along its longitudinal axis at a constant rate of travel.

Figure 4:
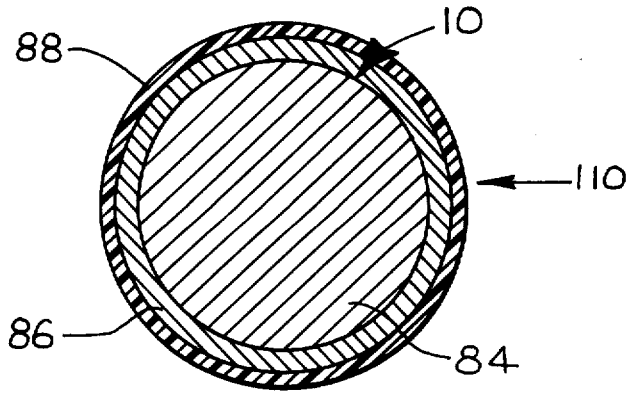

As seen in FIG. 4, the processed rod 110 includes the shot peened rod made of metal 84, the alloy coating is seen at 86, while the baked phenolic resin is suggested at 88.

The processed rod 110 provides an unexpected long life when it is made up into a rod string and employed downhole in a well bore. The phenolic coating protects the rod during outside storage and additionally fills any voids or pits in the coated rod surface. The alloy coating provides a hard surface which likewise fills the imperfections which may be found in the original shot peened surface of the rod. The shot peening of the original rod surface imparts still further desirable physical properties into the rod string. Accordingly, the judicious combination of manipulative steps imparted into the rod jointly cooperate together to provide a new rod which is superior to any known prior art sucker rod string.

I claim:

1. A continuous process for improving ferrous metal sucker rods wherein the rods are protected against corrosion and hydrogen ion embrittlement comprising the steps of:

1. cleaning the surface of the rods to remove debris and scale therefrom;
2. mechanically cold working and further cleaning the exterior surface of the cleaned rods of step (1) by shot peening the surface thereof;
3. electronically inspecting the rods to determine the symmetry of composition;
4. electronically inspecting the rods to determine the presence of flaws therein;
5. discarding those rods of steps (3) and (4) whose structural integrity is deficient for carrying its designed load;
6. coating the exterior surface of the remaining rods of step (5) with a stainless steel metal alloy by using an electric arc metal spray apparatus;
7. carrying out the coating step (6) immediately following the inspection steps (3) and (4); and, carrying out the inspection steps (3) and (4) immediately following the cleaning step (2) so that the coating is applied before appreciable oxidation can occur.

2. The method of claim 1, and further including the step of:

8. painting the exterior surface of the rod with a phenolic resin to provide a continuous plastic-like film over the exterior surface of the rod.

3. The method of claim 2 and further including the step of baking the painted surface.

4. The method of claim 1 and further including the step of preheating the rod prior to step (2) so as to enhance the cleaning and surface hardening action of the shot peening operation.

5. The method of claim 1 wherein step (1) includes preheating the rod to remove grease and other volatile and combustible matter from the surface thereof, and further including the step of preheating the rod to 200° F. prior to the metal coating step.

6. A continuous process for improving ferrous metal sucker rods wherein the rods are protected against corrosion and hydrogen ion embrittlement comprising the step of:

1. cleaning the surface of the rods to remove debris and scale therefrom;

2. mechanically cold working and further cleaning the exterior surface of the cleaned rods of step (1) by shot peening the surface thereof,
3. inspecting the rod for flaws and discarding those rods of step (2) whose structural integrity is deficient for carrying its designed load;
5. coating the exterior surface of the ramaining rods of step (3) with a metallic coating by spraying volatilized stainless steel metal onto the rod by using an electrical arc metal spray apparatus;
4. carrying out the coating step immediately following the insepection step and, carrying out the inspection step immediately following step (2) so as to avoid any appreciable oxidation thereof;
6. coating the exterior surface of the rod with a plastic coating.

7. The method of claim 6 and further including the steps of:

preheating the rod prior to the coating step (4) and cooling the rod prior to the coating step (6).

8. The method of claim 6 and further including the steps of:

carrying out step (6) by spraying the surface of the rod with phenolic resin and baking the resin.

9. The method of claim 6 and further including the steps of:

preheating the rod prior to the coating step (4) and cooling the rod prior to the coating step (6); and carrying out step (6) by spraying the surface of the rod with phenolic resin and baking the resin.

10. The method of claim 6 wherein the rod of claim 1 is used downhole in a borehole prior to carrying out step (1).

* * * * *